US009028160B2

(12) United States Patent
Garcia et al.

(10) Patent No.: US 9,028,160 B2
(45) Date of Patent: May 12, 2015

(54) PRINT SUBSTRATE EDGE GUIDE

(75) Inventors: Daniel Gutièrrez Garcia, Badalona (ES); Ignacio Picatoste Olloqui, Barcelona (ES); Raimon Castells De Monet, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 259 days.

(21) Appl. No.: 13/306,395

(22) Filed: Nov. 29, 2011

(65) Prior Publication Data

US 2013/0136521 A1 May 30, 2013

(51) Int. Cl.

| | |
|---|---|
| ***B41J 11/22*** | (2006.01) |
| ***B41J 11/00*** | (2006.01) |
| ***B41J 15/04*** | (2006.01) |

(52) U.S. Cl.

CPC ..... *B41J 11/005* (2013.01); *B41J 15/046* (2013.01)

(58) Field of Classification Search

CPC ..... B41F 1/36; B41J 11/0025; B41J 11/0045; B41J 11/005; B41J 11/0055; B41J 15/046; B65H 23/032; B65H 23/028; B65H 23/0322; B65H 23/0324; B65H 23/035; B65H 23/28

USPC ..... 400/48, 525, 528, 530, 633, 633.1, 400/633.2, 645, 645.5, 642; 101/474, 480; 399/377, 379; 271/240, 253; 13/48, 13/525, 528, 530, 633, 633.1, 633.2, 645, 13/645.5; 347/104, 101

See application file for complete search history.

(56) References Cited

U.S. PATENT DOCUMENTS

| | | | | |
|---|---|---|---|---|
| 1,824,102 | A * | 9/1931 | Smith | 400/528 |
| 7,050,180 | B1 | 5/2006 | Bingham et al. | |
| 2010/0209169 | A1* | 8/2010 | Mandel et al. | 400/619 |
| 2011/0025796 | A1* | 2/2011 | Matsuya | 347/104 |
| 2011/0038657 | A1 | 2/2011 | Benizri | |
| 2011/0148031 | A1 | 6/2011 | Shih et al. | |
| 2011/0210504 | A1 | 9/2011 | Degruchy | |
| 2011/0271861 | A1* | 11/2011 | Anglada et al. | 101/480 |

FOREIGN PATENT DOCUMENTS

| | | |
|---|---|---|
| JP | 8217284 | 8/1996 |
| JP | 2004090538 | 3/2004 |
| JP | 2004230839 | 8/2004 |

* cited by examiner

*Primary Examiner* — Daniel J Colilla
*Assistant Examiner* — Justin Olamit

(57) ABSTRACT

In one example, a device for use in a printer includes a flexible piece and a holder configured to removably attach the piece to a platen that has a surface over which a print substrate is moved through the print zone for printing on the substrate. The piece and the holder are configured to place the piece in tension along the platen surface such that, when the piece is attached to the platen, the piece becomes sufficiently rigid to counter substrate edge curl.

19 Claims, 12 Drawing Sheets

PRINT SUBSTRATE EDGE GUIDE

BACKGROUND

The side edges of flexible print substrates may curl as the substrate moves through the print zone. Large format inkjet printers, for example, may print on paper, vinyl and textiles in varying widths supplied as rolls of flexible web. The edges of the print substrate should be kept flat against the platen as the substrate passes through the print zone during printing.

DRAWINGS

FIGS. 1-3 are plan and elevation views illustrating a roll-to-roll web substrate type printer in which examples of a new substrate edge guide may be implemented. The elevation view of FIG. 2 is taken along the line 2-2 in FIG. 1. The elevation view of FIG. 3 is taken along the line 3-3 in FIG. 2.

FIGS. 4 and 5 are perspective views illustrating one example of a pair of new substrate edge guides. FIG. 4 shows the edge guides in place on the platen over the side edges of a print substrate. FIG. 5 shows the edge guides in alternate positions on the platen but with the print substrate omitted to better show some of the features of the platen and edge guides.

The same part numbers designate the same or similar parts throughout the figures.

DESCRIPTION

The examples shown in the figures and described below illustrate but do not limit the invention, which is defined in the claims following this Description.

Figure 1:
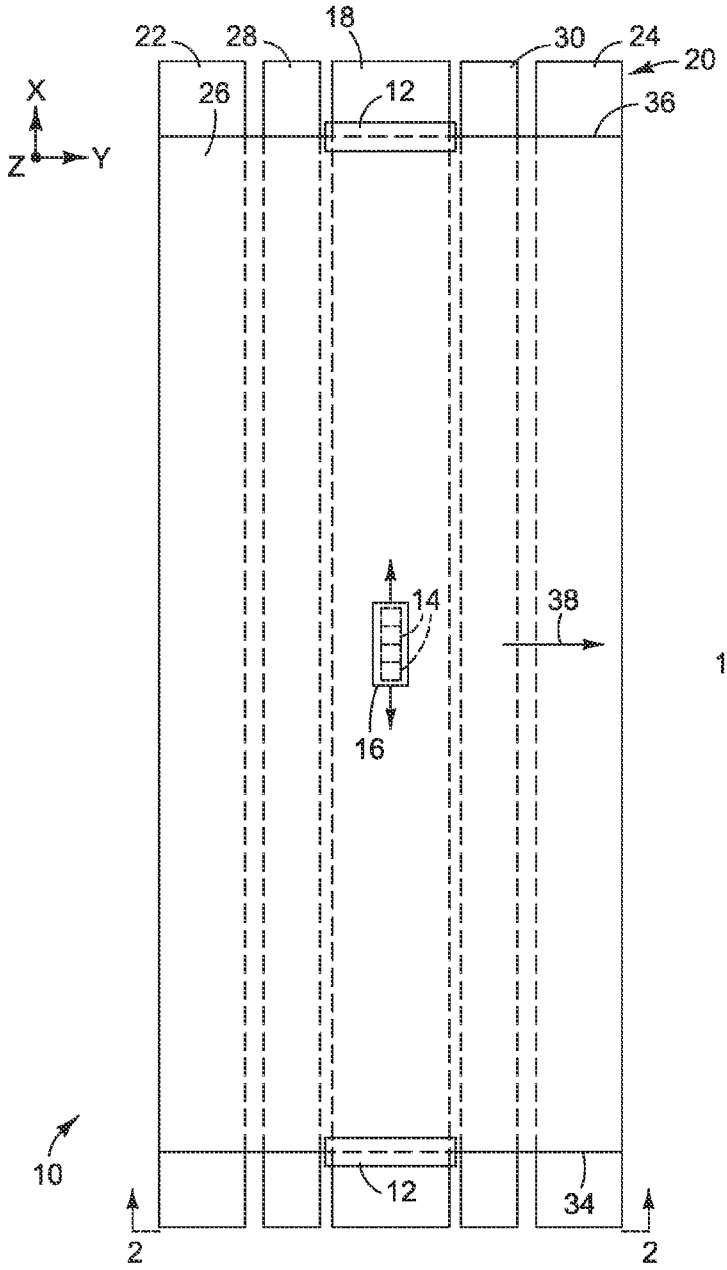
Figure 3:
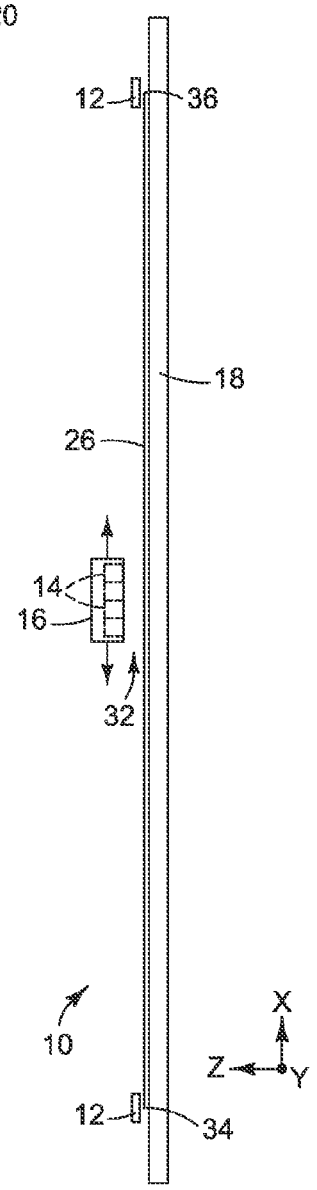
Figure 2:
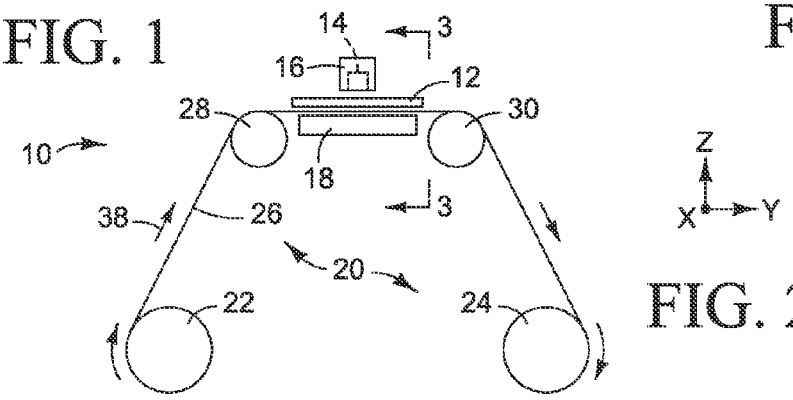

FIGS. 1-3 are plan and elevation views illustrating one example of a roll-to-roll web substrate printer 10 in which new substrate edge guides 12 may be implemented. As discussed in detail below, in one example for each new edge guide 12, a flexible strip is placed in tension along the surface of the print platen over one edge of the substrate. The tension makes the strip sufficiently rigid to counter substrate edge curl while retaining enough flexibility to accommodate print substrates of varying thicknesses. The strip is affixed to a holder configured to attach the strip to and remove the strip from the platen at any of multiple positions across the platen to accommodate print substrates of varying widths.

Referring now to FIGS. 1-3, printer 10 includes a group of multiple ink pens 14 for dispensing different color inks. Ink pens 14 are mounted on a carriage 16 over a platen 18. A substrate transport 20 in printer 10 includes a web supply roller 22 and a web take-up roller 24. A web print substrate 26 extends from supply roller 22 over platen 18 and intermediate rollers 28, 30 to take-up roller 24. Intermediate rollers 28, 30, for example, help control the direction and tension of web 26 through a print zone 32 over platen 18. Pens 14 are scanned back and forth on carriage 16 across the width of substrate 26 as it passes over platen 18 through print zone 32. Edge guides 12 keep the side edges 34, 36 of print substrate 26 flat on platen 18 through print zone 32.

Figure 4:
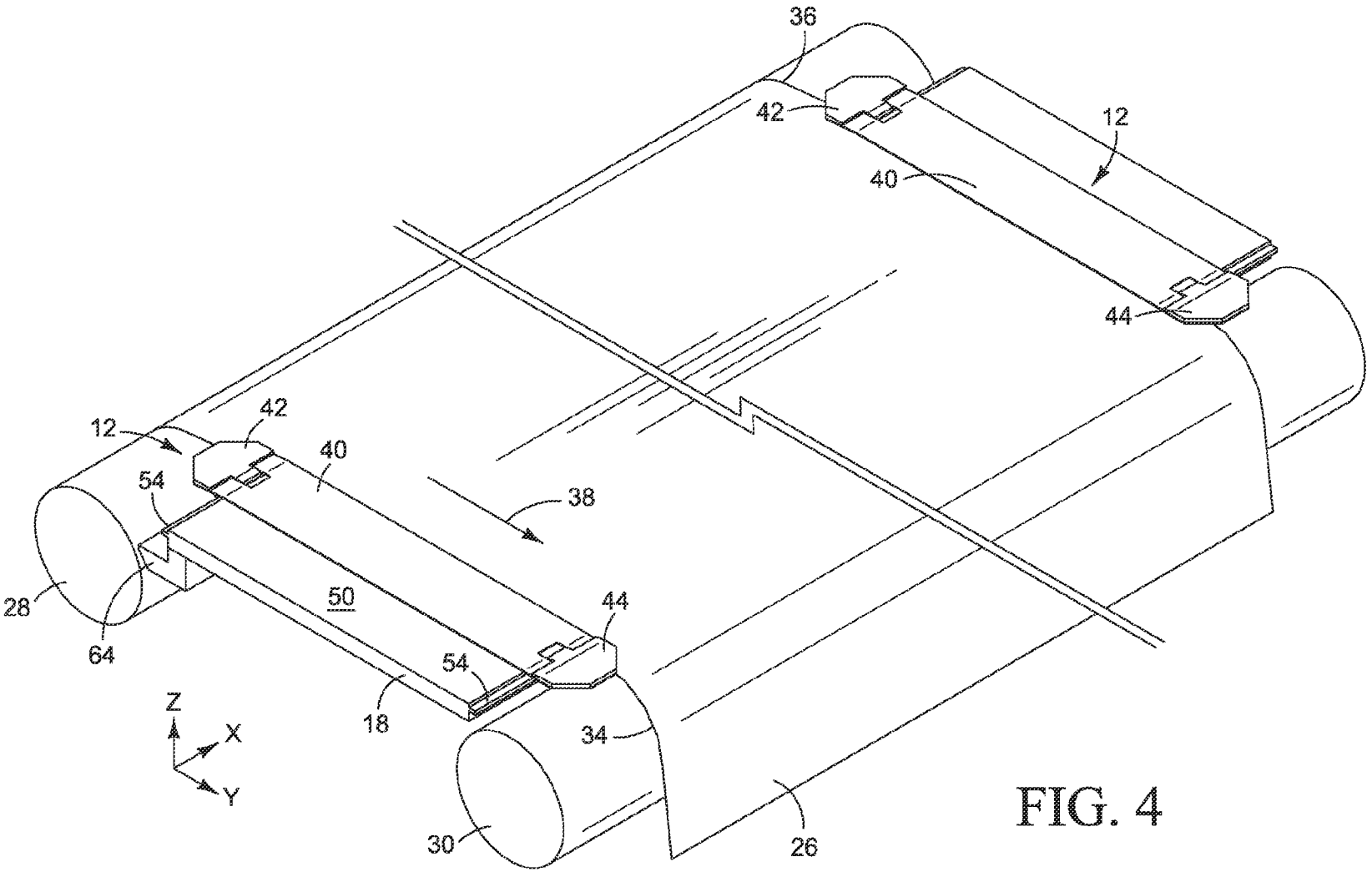
Figure 5:
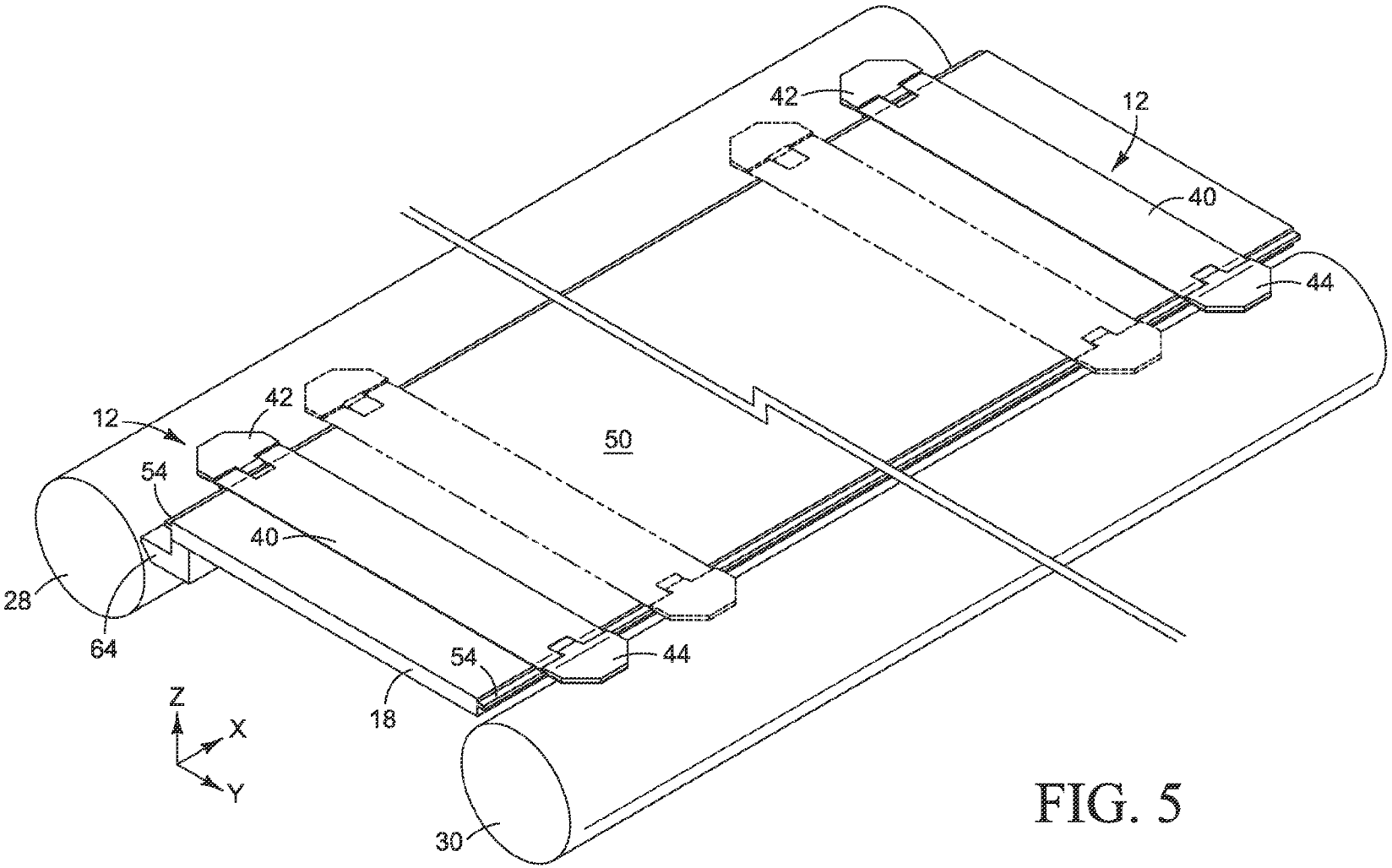
Figure 7:
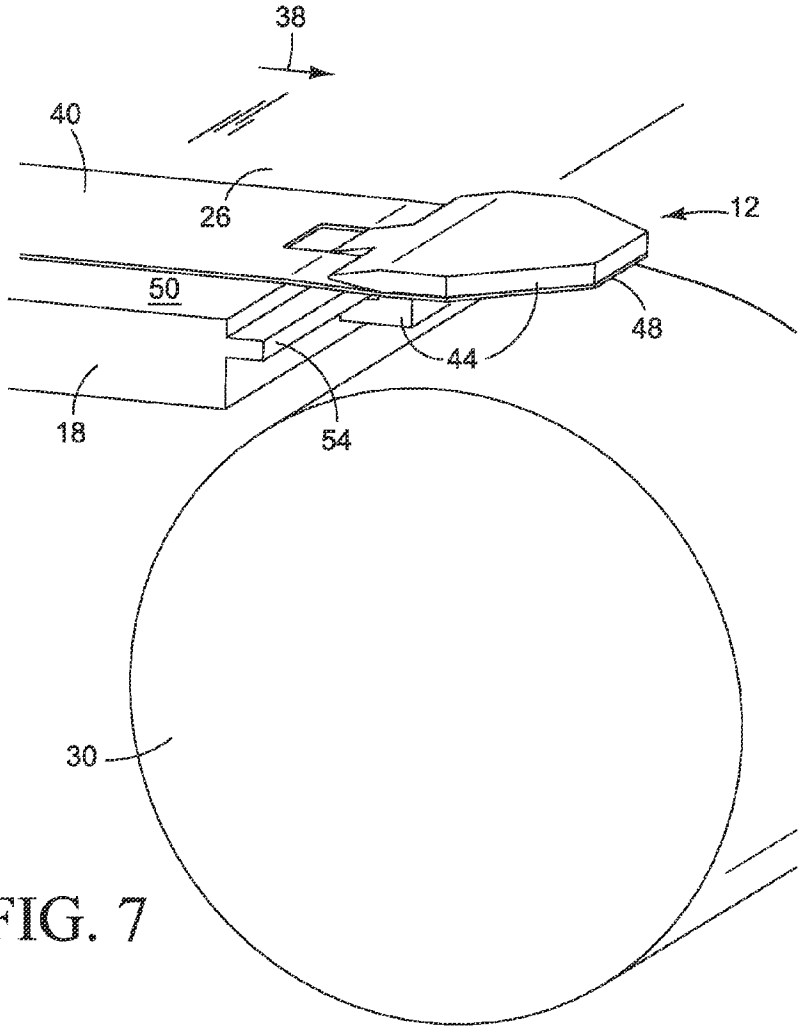
FIGS. 6 and 7 are close-up perspective views illustrating each end of an edge guide from FIGS. 4 and 5.
Figure 6:
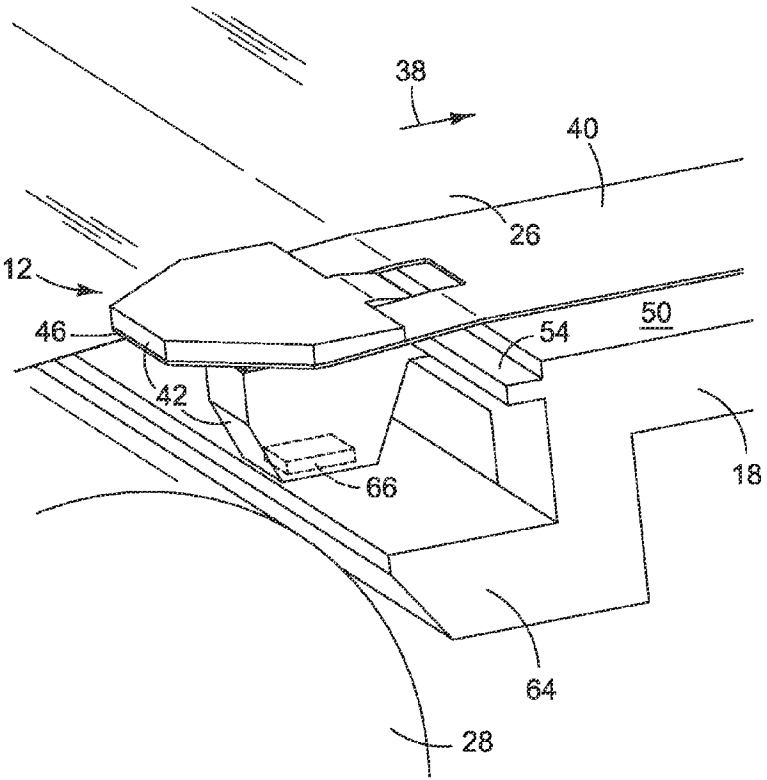
Figure 8:
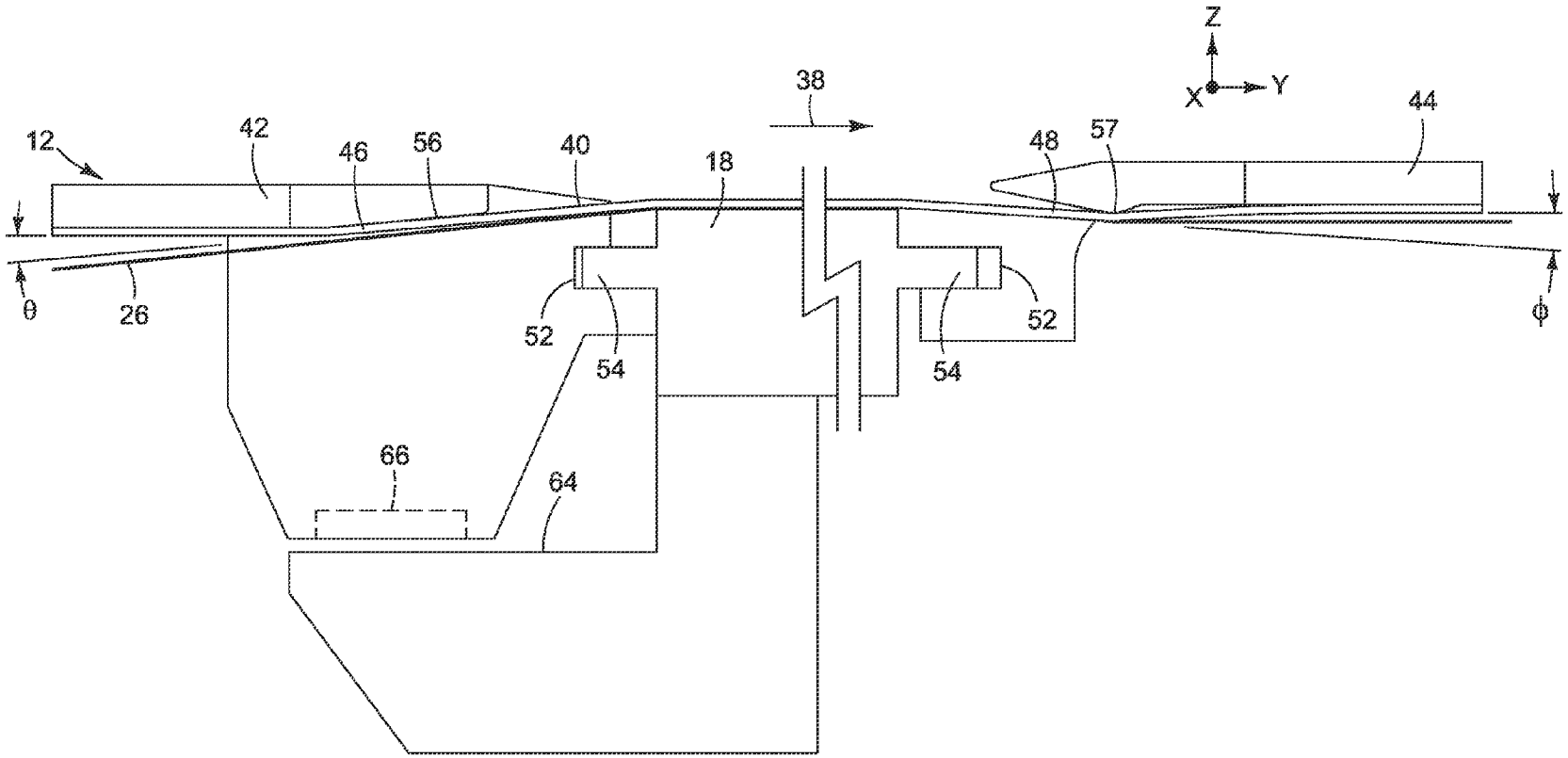
FIG. 8 is a close-up elevation view illustrating an edge guide from FIGS. 4 and 5.

FIGS. 4 and 5 are perspective views illustrating one example of a new substrate edge guide 12 such as might be implemented in a printer 10 shown in FIGS. 1-3. FIG. 4 shows edge guides 12 in place over edges 34, 36 of a substrate 26. Substrate 26 is omitted from FIG. 5. FIGS. 6 and 7 are close-up perspective views illustrating each end of an edge guide 12 shown in FIGS. 4 and 5. FIG. 8 is a close-up elevation view illustrating an edge guide 12 from FIGS. 4 and 5. The direction print substrate 26 moves through print zone 32 is indicated by arrows 38 in the figures. "Upstream" and "downstream" refers to the direction substrate 26 moves through print zone 32. "Length" is along the Y direction, the direction substrate 26 moves through print zone 32. "Width" is across in the X direction, perpendicular to the direction substrate 26 moves through print zone 32. Thus, in the example shown in FIGS. 1-5, platen 18 is much wider than it is long.

Referring to FIGS. 4-8, each of a pair of edge guides 12 holds down a respective edge 34, 36 of substrate 26. Each guide 12 includes a flexible strip 40 and holders 42, 44 for attaching guide 12 to and detaching guide 12 from platen 18. (Holders 42, 44 and strip 40 are shown in detail in FIGS. 13-16 and FIG. 17, respectively.) First holder 42 is affixed to an upstream end 46 of strip 40 and second holder 44 attached to a downstream end 48 of strip 40. Strip 40 and holders 42/44 are configured to place strip 40 in tension along the exposed face 50 of platen 18 so that the otherwise flexible strip 40 becomes sufficiently rigid in the Z direction (perpendicular to the plane of platen face 50) to counter substrate edge curl in print zone 32. In the example shown in FIGS. 4-8, an elastic (i.e. stretchy) strip 40 is stretched across platen face 50 to achieve the desired tension. In another example described below with reference to FIGS. 18-24 a spring loaded inelastic (i.e. not stretchy) strip 40 is used to achieve the desired tension.

Each holder 42, 44 includes a slot 52 that fits on to a flange 54 protruding from each side of platen 18. In the example shown, as best seen in FIG. 5, platen flange 54 extends along substantially the full width of platen 18 so that each guide 12 may be attached at a continuum of multiple positions laterally across the width of platen 18. Thus, edge guides 12 are adjustable to any location across platen 18 to accommodate different sizes of print substrate 26. (Edge guides 12 are shown at two alternate positions across platen 18 in FIG. 5—one position is indicated by solid lines and another position is indicated by phantom lines.)

In the example shown, in addition to placing strip 40 in tension for rigidity in the Z direction, strip 40 is also biased downward to press against platen face 50 to help control substrate edges 34, 36 in print zone 32. Referring specifically to FIG. 8, to bias the tensioned flexible strip 40 against platen face 50, each strip end 46, 48 is positioned below platen face 50 when edge guide 12 is attached to platen 18. Accordingly, at upstream end 46, strip 40 comes up to platen face 50 at an angle $\theta$. At downstream end 48, strip 40 falls off platen face 50 at an angle $\phi$. At upstream end 48, the entry area for substrate 26, a smooth transition to tangency between substrate 26 and strip 40 may be desirable to avoid local deformation of substrate 26 entering print zone 32. Thus, strip upstream end 46 is affixed to holder 42 along a smooth ramp 56. By contrast, at the exit area for substrate 26, strip downstream end 48 is affixed to holder 44 over a protrusion 57 that positions strip end 48 below platen face 50. Although the comparatively abrupt change in direction at protrusion 57 may create a risk of local deformation of substrate 26, substrate deformation downstream of print zone 32 is less significant and the severity of the risk may be minimized through the configuration of protrusion 57. While the characteristics of strip 40 and other factors may affect the desirable size of each angle θ and ϕ, in general it is expected that angles θ and ϕ in the range of 3° to 7.5° will impart adequate biasing to strip 40 without impeding the movement of print substrate 26 along platen face 50.

Figure 9:
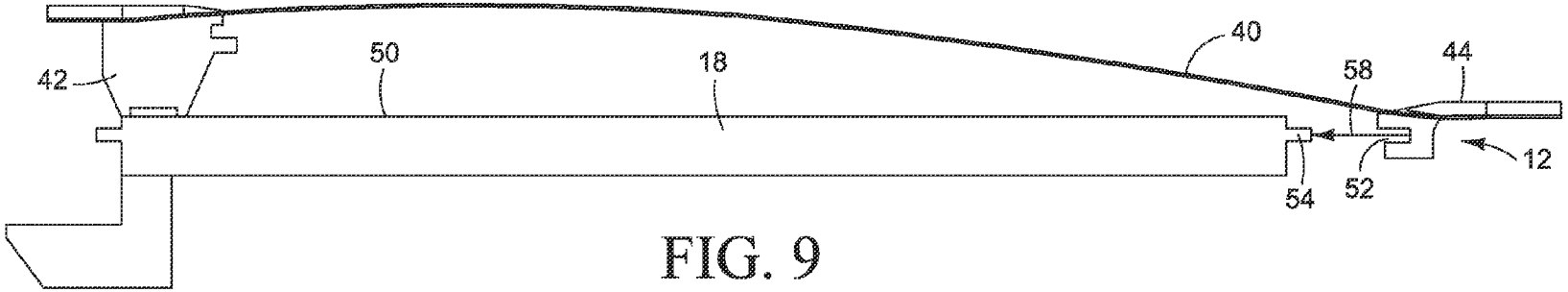
FIGS. 9-11 are a series of elevation views illustrating the attachment of one of the edge guides shown in FIGS. 4 and 5 to the printer platen.
Figure 10:
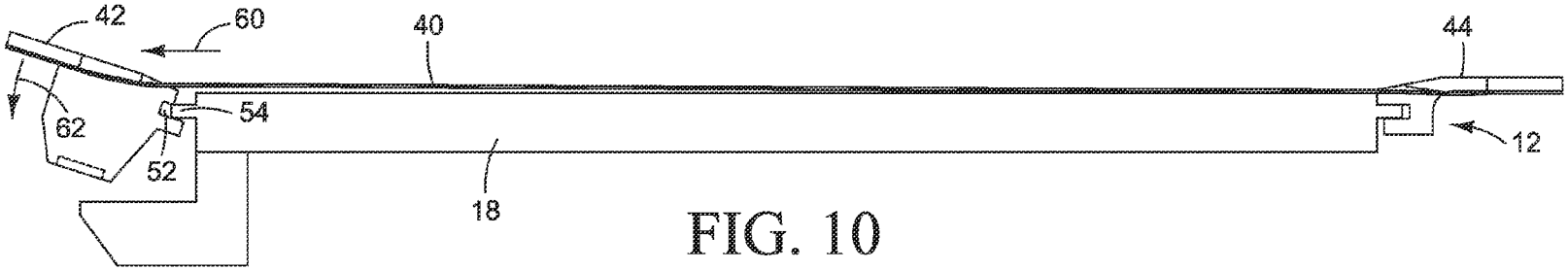
Figure 11:
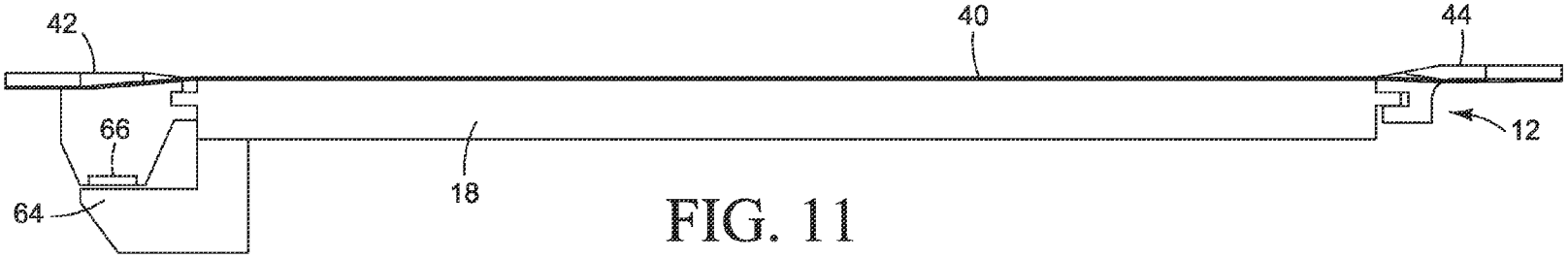

FIGS. 9-11 illustrate the attachment of an edge guide 12 to platen 18. Referring first to FIG. 9, slot 52 on downstream holder 44 is placed over platen flange 54, as indicated by direction arrow 58. When not under tension, as in FIG. 9, the position of edge guide 12 on platen 18 may be adjusted by sliding holder 44 along platen flange 54. Referring to FIG. 10, once downstream holder 44 is in the desired position, strip 40 is stretched, as indicated by direction arrow 60, until slot 52 on upstream holder 42 can be placed over platen flange 54. Holder 42 is then rotated down, as indicated by direction arrow 62 in FIG. 10, to seat platen flange 54 in holder slot 52 and secure edge guide 12 in position on platen 18, as shown in FIG. 11. For added stability, holder 42 may abut a stop or other stationary feature 64 at the fully seated position. A suitable retainer may be used to help retain holder 42 in the fully seated position. For example, a suitable retainer may include a magnet 66 fitted into the bottom of holder 42 and a ferromagnetic stop 64. The use of magnet 66 and stop 64, or another suitable retainer, also helps the user easily determine when holder 42 is fully seated—if magnet 66 has not closed onto stop 64, then the user knows holder 42 is not fully seated.

Figure 12:
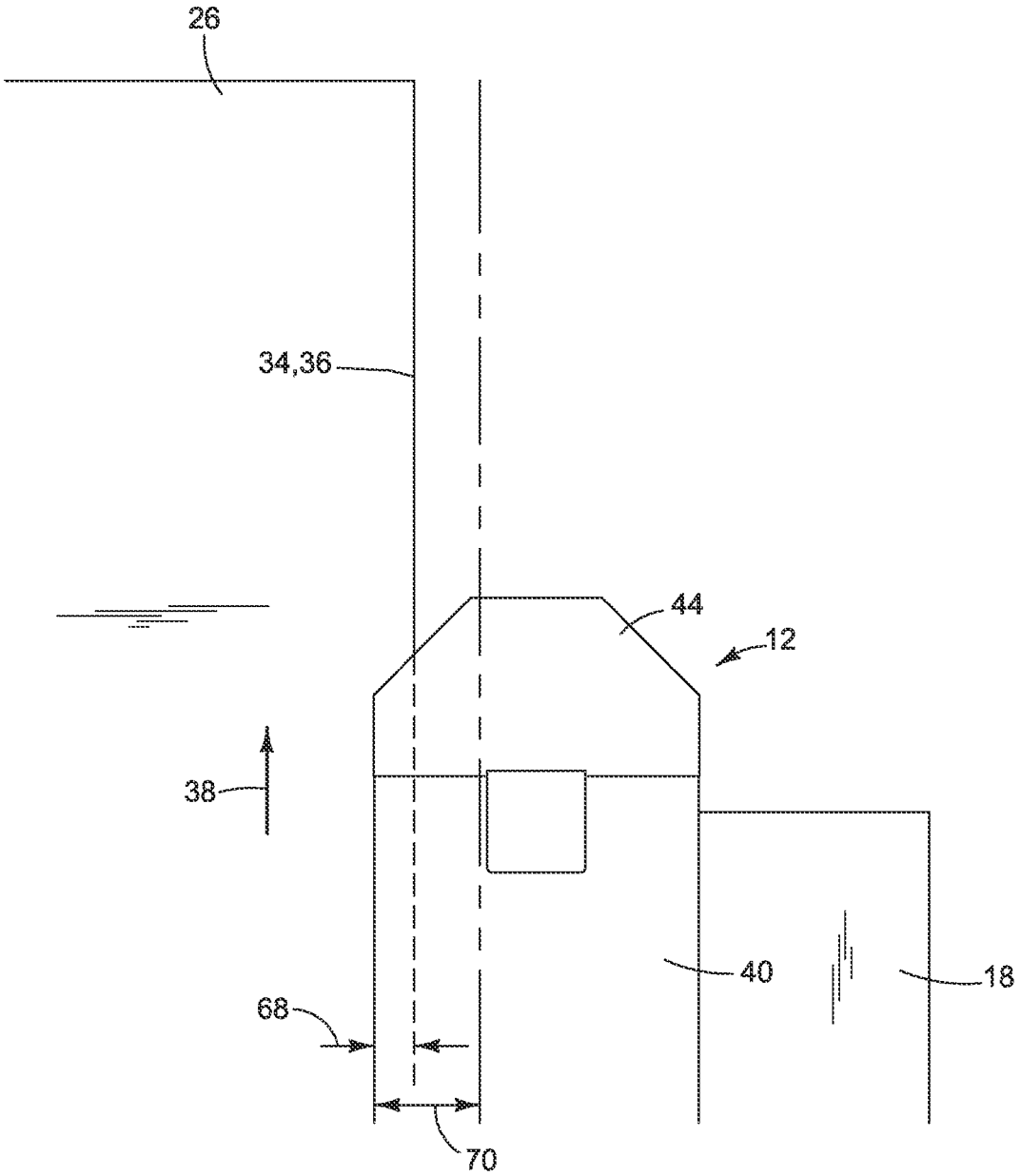
FIG. 12 is a close-up plan view illustrating one end of an edge guide from FIGS. 4 and 5.
Figure 14:
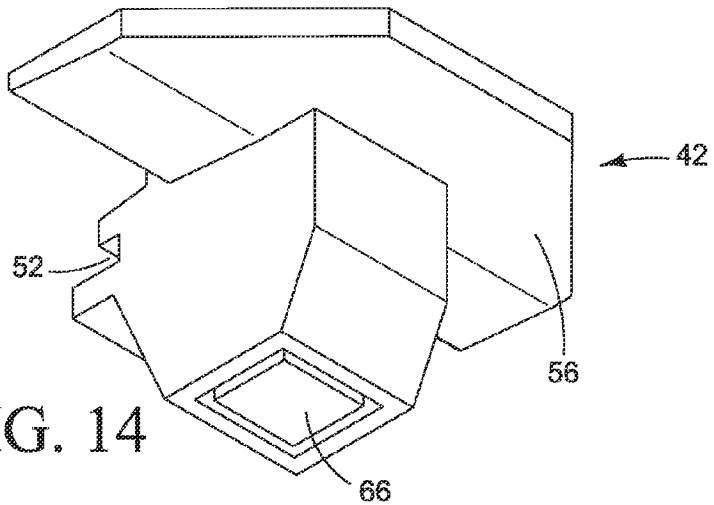
FIGS. 13 and 14 are detail views illustrating the upstream holder for an edge guide from FIGS. 4 and 5.
Figure 16:
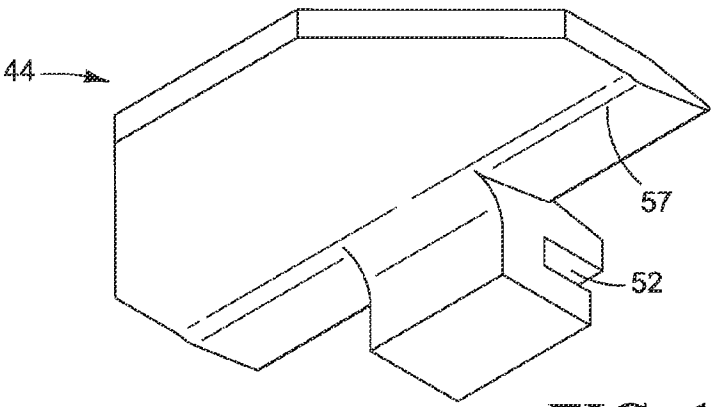
FIGS. 15 and 16 are detail views illustrating the downstream holder for an edge guide from FIGS. 4 and 5.
Figure 13:
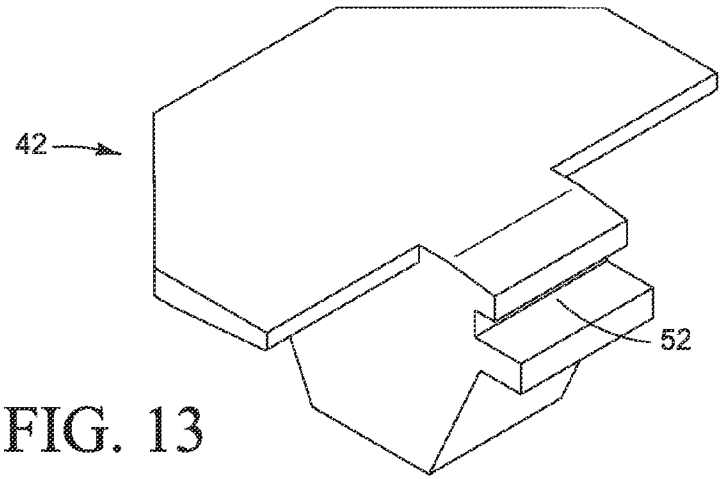
Figure 15:
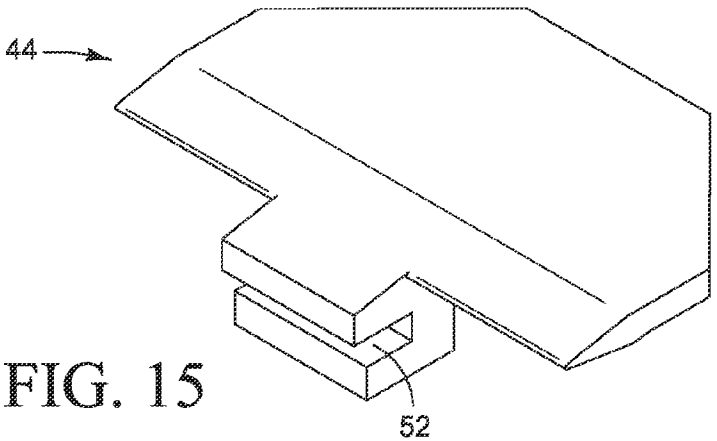
Figure 17:
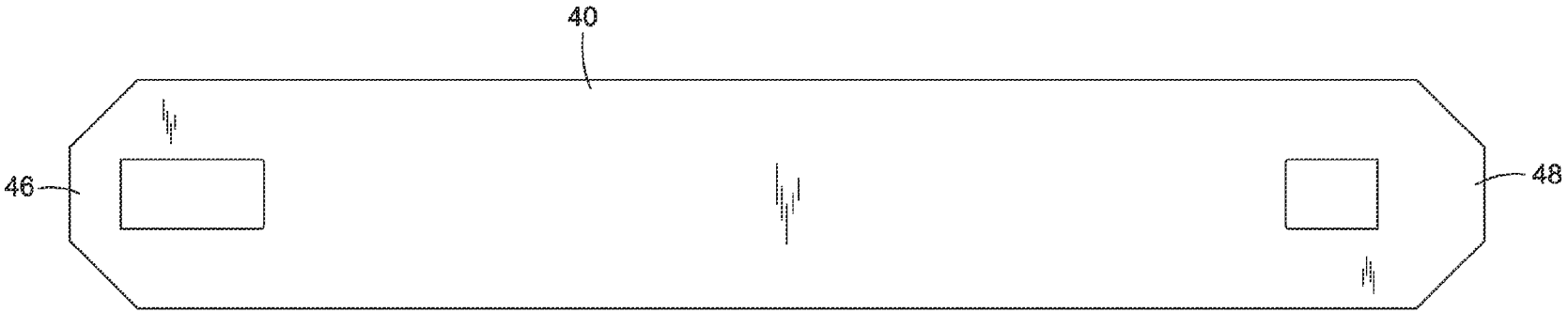
FIG. 17 is a detail view illustrating the flexible strip for an edge guide from FIGS. 4 and 5.
Figure 19:
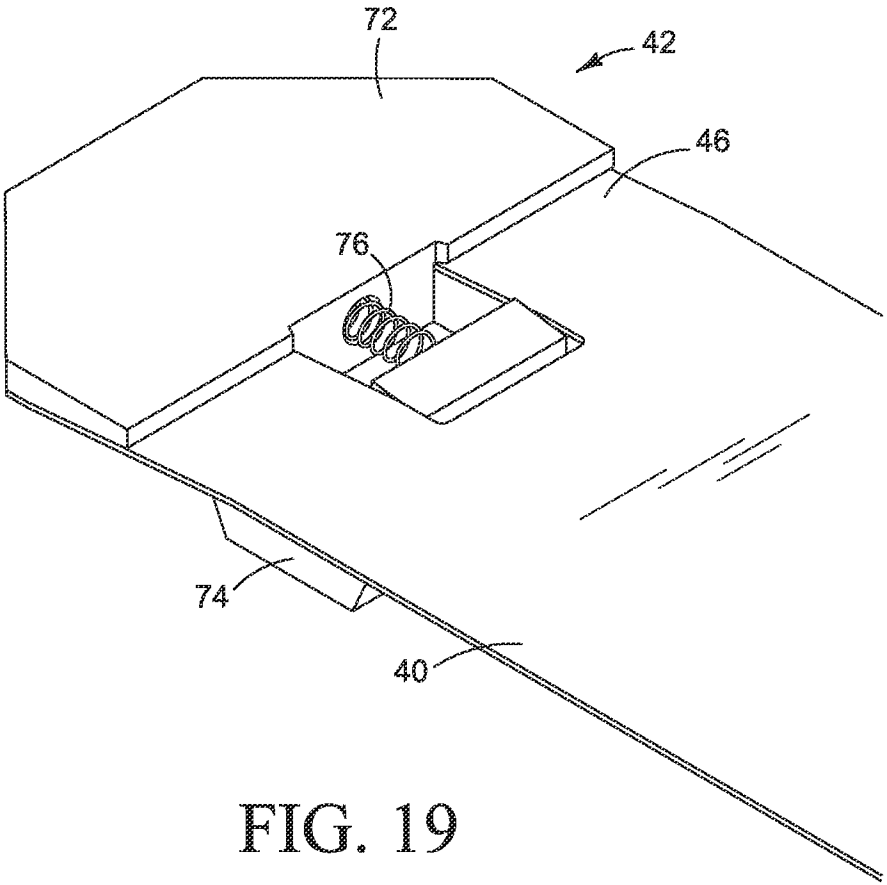
FIGS. 18-21 are detail views illustrating another example of the new substrate guide.
Figure 18:
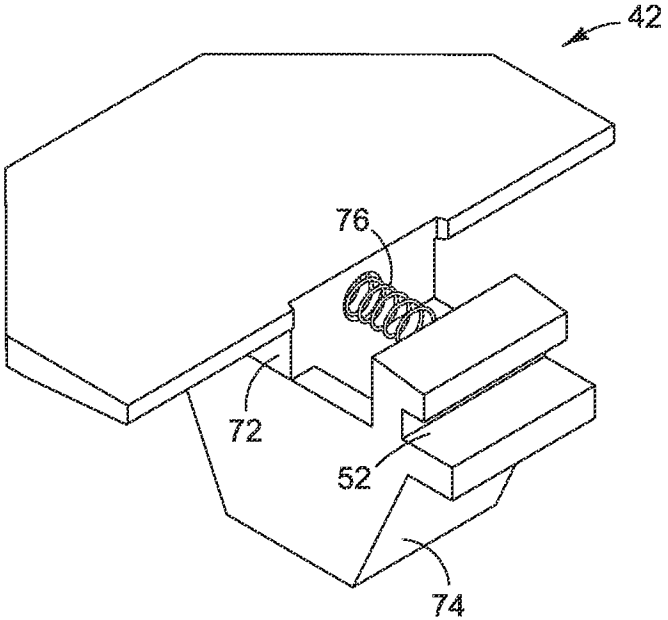
Figure 21:
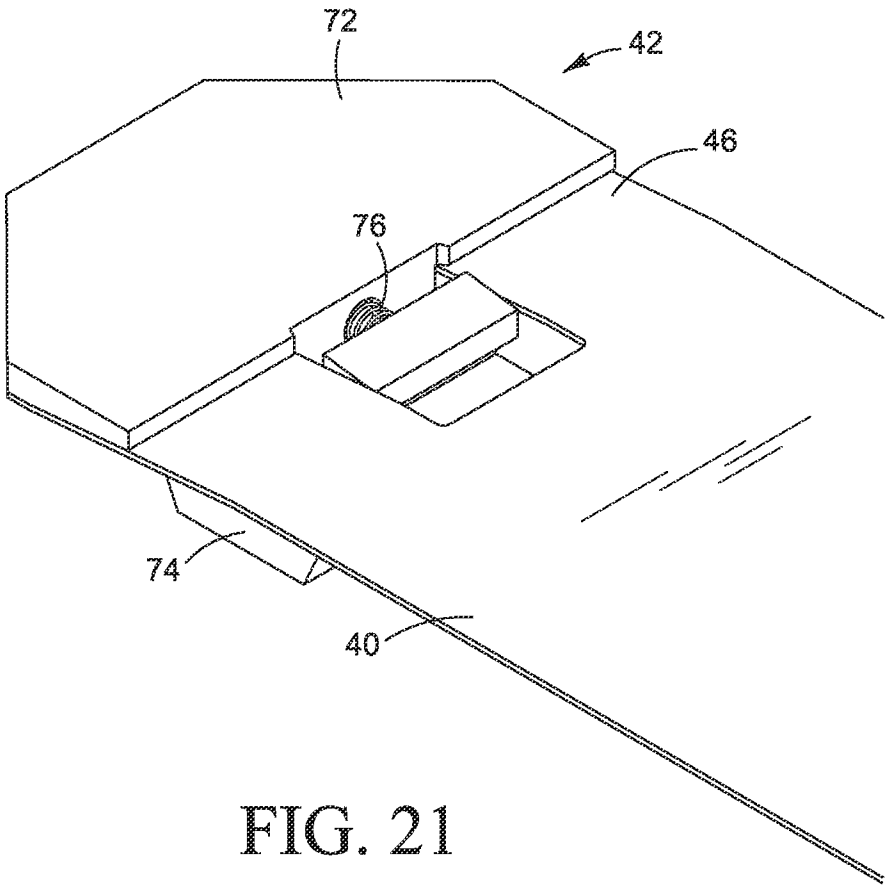
Figure 20:
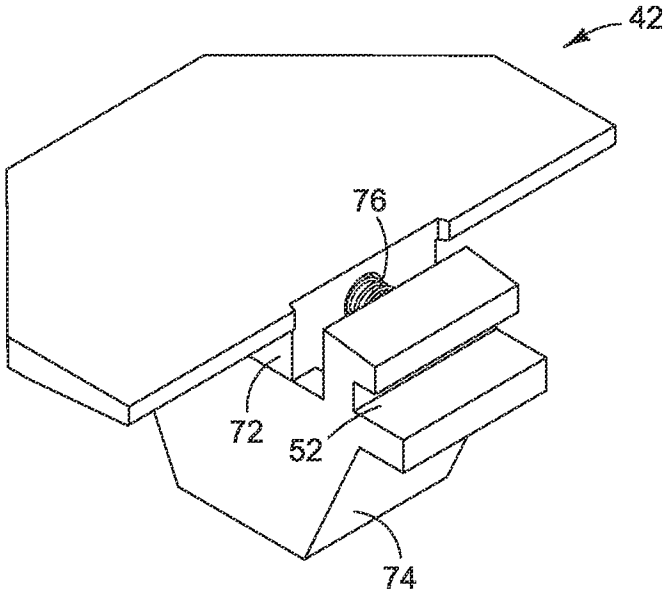

While any suitable mechanism may be used to affix strip 40 to holders 42, 44, sufficient clearance must be allowed to cover the substrate edge with an appropriate tolerance for variations in the width of substrate 26. Referring to the plan view detail in FIG. 12, for many large format printing applications, it is expected that edge curl will be adequately suppressed if strip 40 covers 5-10 mm of substrate edge 34, 36, as indicated by dimension 68 in FIG. 12. The position of a substrate edge 34, 36 at print zone 32 may vary up to ±5 mm from a nominal center for these same large format printing applications. Hence, edge guide 12 should allow up to 20 mm of possible edge overlap, as indicated by dimension 70 in FIG. 12. Also, while it is expected that strip 40 will usually be significantly longer than it is wide (hence the term "strip"), strip 40 need not be long and narrow. Strip 40 might be comparatively short and wide, for example where platen 18 is short and/or where the variability in the width of substrate 26 is great. Thus, strip 40 may be referred to more generally as a flexible "piece" 40 between holders 42, 44.

In another example, shown in FIGS. 18-24, edge guide 12 includes a spring loaded flexible but inelastic strip 40. Referring to FIGS. 18-21, upstream holder 42 includes a first part 72 holding the upstream end 46 of a flexible, inelastic strip 40 and a second part 74 operatively connected to first part 72 through a spring 76. Holder first part 72 slides in or otherwise moves with respect to holder second part 74, as best seen by comparing the relative positions of parts 72 and 74 in FIGS. 18, 19 and FIGS. 20, 21.

Figure 22:
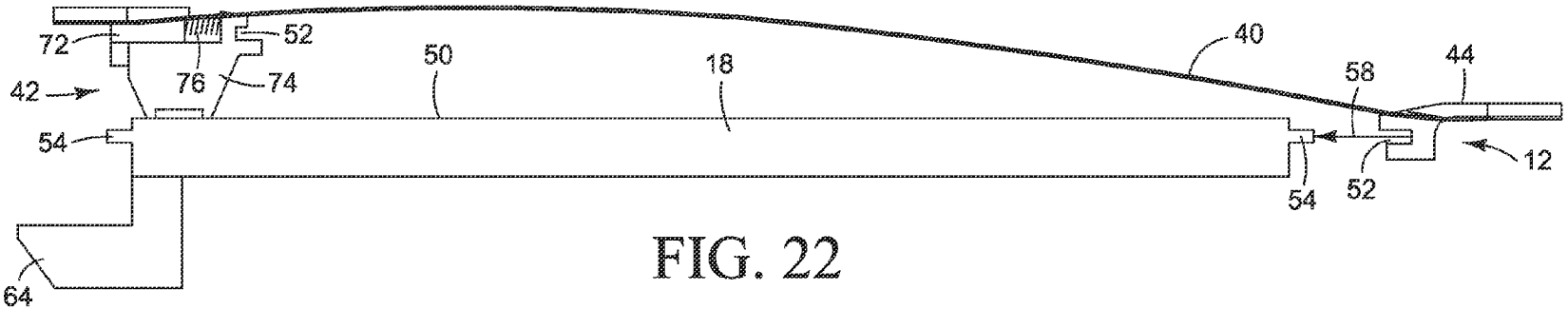
FIGS. 22-24 are a series of elevation views illustrating the attachment of the edge guide shown in FIGS. 18-21 to a printer platen.
Figure 23:
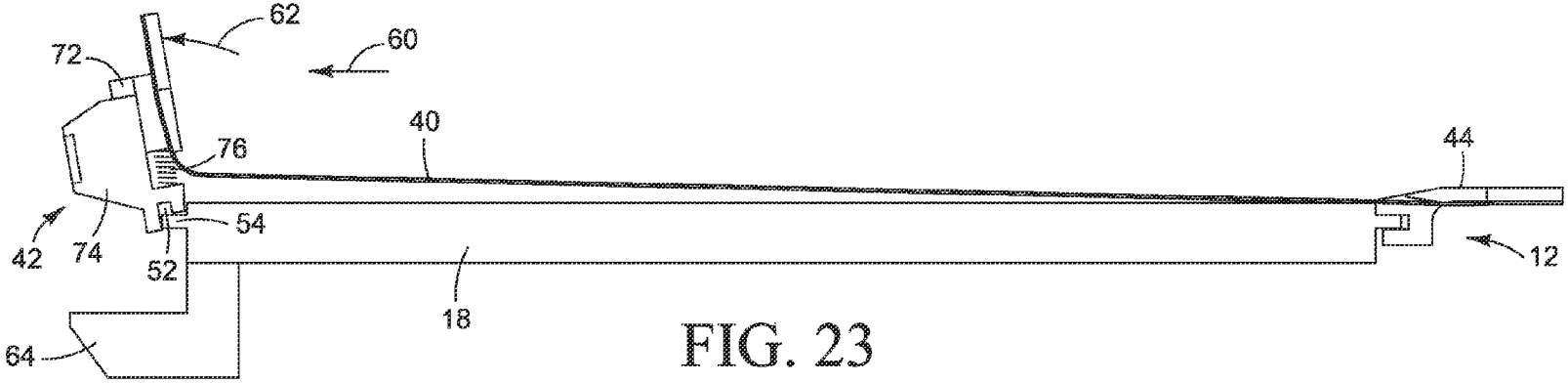
Figure 24:
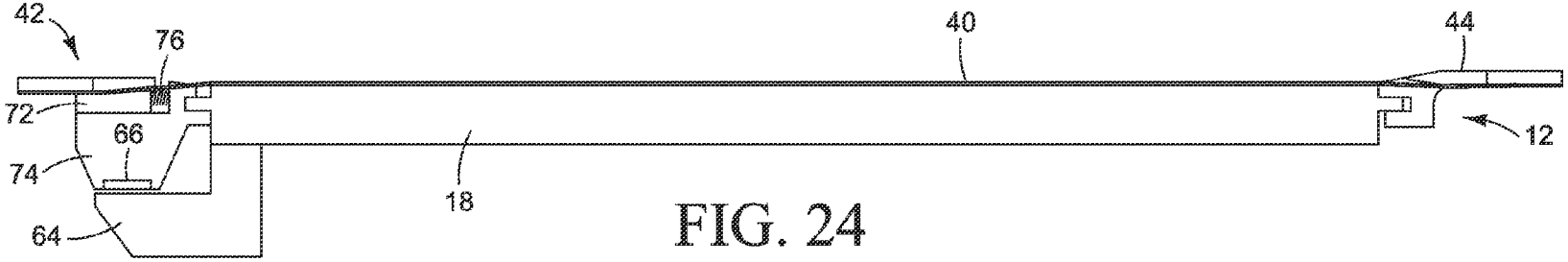

The attachment of this example of edge guide 12 to platen 18 is shown in FIGS. 22-24. Referring to FIG. 22, slot 52 on downstream holder 44 is placed over platen flange 54, as indicated by direction arrow 58. When not under tension, as in FIG. 22, spring 76 is extended and the position of edge guide 12 on platen 18 may be adjusted by sliding holder 44 along platen flange 54. The position of holder parts 72, 74 and spring 76 in FIG. 22 corresponds to that shown in FIGS. 18 and 19. Once downstream holder 44 is in the desired position, upstream holder 42 is tilted up until holder second part 74 can be brought into contact with platen flange 54 at slot 52 as shown in FIG. 23. Holder 42 is then rotated down, as indicated by direction arrow 62 in FIG. 23, to seat platen flange 54 in holder slot 52 and compress spring 76 as shown in FIG. 24. The position of holder parts 72, 74 and spring 76 in FIG. 24 corresponds to that shown in FIGS. 20 and 21. The compressed spring 76 places strip 40 in tension along the exposed face 50 of platen 18 so that the otherwise flexible strip 40 becomes sufficiently rigid to counter substrate edge curl in the print zone.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A device for use in a printer that includes a platen having a platen surface over which a print substrate is moved through a print zone for printing on the substrate, the device comprising:

a flexible piece; and a pair of holders secured to opposite ends of the piece, the holders configured to releasably engage the platen and removably attach the piece to the platen at multiple positions across a width of the platen;

the piece and the holders configured to place the piece in tension along the platen surface such that, when the piece is attached to the platen, the piece and the holders are each configured to overlap an edge of the substrate to counter substrate edge curl.

2. The device of claim 1, wherein the piece and the holders are configured to place the piece in tension along the platen surface such that the piece presses against the platen surface when the piece is attached to the platen.

3. The device of claim 1, wherein a first holder of the pair of holders is configured to hold one end of the piece below the platen surface and a second holder of the pair of holders is configured to hold the other end of the piece below the platen surface.

4. The device of claim 3, wherein the first holder and the one end of the piece are configured to guide the edge of the substrate from below to above the platen surface, and wherein the second holder and the other end of the piece are configured to guide the edge of the substrate from above to below the platen surface.

5. The device of claim 1, wherein the piece comprises an elastic piece stretched between a first holder of the pair of holders at one end of the piece and a second holder of the pair of holders at the other end of the piece.

6. The device of claim 1, wherein the piece comprises an inelastic piece attached to a first holder of the pair of holders by a spring at one end of the piece and attached to a second holder of the pair of holders at the other end of the piece.

7. The device of claim 1, wherein the holders are configured to attach the piece to the platen at a continuum of multiple positions across the width of the platen.

8. The device of claim 1, wherein the holders are secured to the piece through openings provided at opposite ends of the piece.

9. An edge guide for a print substrate, comprising:

a flexible strip;

a first holder on a first end of the strip for removably attaching the first end of the strip to an upstream part of a platen having a surface over which the substrate is moved for printing;

a second holder on a second end of the strip for removably attaching the second end of the strip to a downstream part of the platen;

the strip and the first holder presenting an upstream substrate edge guide surface that, when the strip is attached to the platen, lies below a plane of the surface of the platen to direct an edge of the substrate from below to above the surface of the platen; and the strip and the second holder presenting a downstream substrate edge guide surface that, when the strip is attached to the platen, lies below the plane of the surface of the platen to direct the edge of the substrate from above to below the surface of the platen.

10. The guide of claim 9, wherein the first and second holders are configured to removably attach the strip to the platen at a continuum of multiple positions across a width of the platen.

11. The guide of claim 10, wherein each holder includes a slot configured to fit over a flange on the platen to removably attach the strip to the platen.

12. The guide of claim 9, wherein the flexible strip comprises an elastic piece stretched between the first and second holders when the strip is attached to the platen.

13. The guide of claim 9, wherein the flexible strip comprises an inelastic piece extended between the first and second holders when the strip is attached to the platen, wherein the first holder is spring-biased between the strip and the platen.

14. The guide of claim 9, wherein the first holder extends through a first opening provided at the first end of the strip, and wherein the second holder extends through a second opening provided at the second end of the strip.

15. The guide of claim 9, wherein the first holder is configured to bias the first end of the strip downward from above to below the plane of the surface of the platen, and wherein the second holder is configured to bias the second end of the strip downward from above to below the plane of the surface of the platen.

16. The guide of claim 9, further comprising:

the strip presenting an intermediate substrate edge guide surface that, when the strip is attached to the platen, lies above the plane of the surface of the platen to guide the edge of the substrate along the surface of the platen.

17. A device for a printer, comprising:

a platen in a print zone through which a print substrate moves over the platen for printing;

a pair of substrate edge guides for holding down edges of the print substrate as the print substrate moves over the platen through the print zone, each edge guide comprising a flat strip releasably secured in tension across the platen by a pair of holders engaged with the platen and secured to the platen through openings provided in opposite ends of the flat strip;

wherein the flat strip of each edge guide is releasably secured in tension across the platen and biased against the platen; and wherein the flat strip comprises:

an elastic piece stretched between the holders; or an inelastic piece extended between the holders, wherein a spring is to bias one of the holders against the piece and the platen.

18. The device of claim 17, wherein a position of each edge guide is adjustable through a continuum of multiple positions across a width of the platen.

19. A device for a printer, comprising:

a platen in a print zone through which a print substrate moves over the platen for printing;

a pair of substrate edge guides for holding down edges of the print substrate as the print substrate moves over the platen through the print zone, each edge guide comprising a flat strip releasably secured in tension across the platen by a pair of holders engaged with the platen and secured to the platen through openings provided in opposite ends of the flat strip;

wherein a first holder of the pair of holders and a first end of the flat strip are configured to guide an edge of the substrate from below to above a surface of the platen, and wherein a second holder of the pair of holders and a second end of the flat strip are configured to guide the edge of the substrate from above to below the surface of the platen; and wherein the flat strip comprises:

an elastic piece stretched between the holders; or an inelastic piece extended between the holders, wherein a spring is to bias one of the holders against the piece and the platen.

* * * * *